United States Patent [19]

Young

[11] Patent Number: 4,786,535

[45] Date of Patent: Nov. 22, 1988

[54] POMPON

[76] Inventor: Gordon Young, 1728 Rosemeade Cir., Carrollton, Tex. 75007

[21] Appl. No.: 121,162

[22] Filed: Nov. 16, 1987

[51] Int. Cl.[4] ..... D04D 7/06

[52] U.S. Cl. ..... 428/4; 428/9; 428/34.2; 428/36.9

[58] Field of Search ..... 428/4, 5, 18, 9, 36

[56] References Cited

U.S. PATENT DOCUMENTS

| | | | |
|---|---|---|---|
| 1,014,408 | 1/1912 | Metzger | 428/4 |
| 1,919,450 | 7/1933 | Rubin | 428/4 |
| 3,003,623 | 10/1961 | Paul et al. | 428/18 X |
| 3,560,313 | 2/1971 | Herkimer | 428/4 |
| 3,574,102 | 4/1971 | Hermanson | 428/9 |
| 4,055,840 | 10/1977 | Uchytil et al. | 428/4 X |
| 4,172,913 | 10/1979 | Ballah et al. | 428/9 |
| 4,201,806 | 5/1980 | Cole | 428/4 |

*Primary Examiner*—Henry F. Epstein
*Attorney, Agent, or Firm*—Myron Amer

[57] ABSTRACT

A pompon with pull strings extending in opposite directions therefrom so that when alternately pulled in the directions of the strings, it is either pulled out of, and into, a hollow tubular handle and, in this manner, provided with a display or storage modes.

3 Claims, 1 Drawing Sheet

POMPON

The present invention relates generally to an improved pompon and more particularly to one that can be used to store its streamers within a tubular handle for same.

Traditionally, pompons have been used at celebrations and sporting events, by cheerleaders and audience alike, to bolster enthusiasm and spirits amongst participants. On occasion, event sponsors supply pompons at considerable expense.

It is an object of the present invention to provide a pompon that is so inexpensive as to be used as a giveaway and to be expendible.

It is another object of the present invention to provide a pompon whose streamer array can be stored within its tubular handle.

A tubular handle is used to enclose a streamer carrier which can be manipulated from without by a pair of strings, respectively, to pull out or pull in the streamers relative to the handle, for display or storage of the pompon. Streamers and the handles for same can be used to display school colors, and the exterior of the tube handle can even portray advertising matter.

BRIEF DESCRIPTION OF THE DRAWINGS

The above brief description, when taken in conjunction with the below described drawings, will further develop the objects, features and advantages of the present invention.

As is the custom, pompons can be waved about singly or in pairs, at random or in organized routines, by individuals or cadenced groups. In FIG. 1 is shown an individual 12 waving a pompon 10. The pompon 10 is comprised principally of a tubular handle 14 and an array of streamers 16. FIGS. 2 and 4 further show the pompon in its ready-to-use mode.

Figures 1, 2, 3, 4, 5, 6, 7:
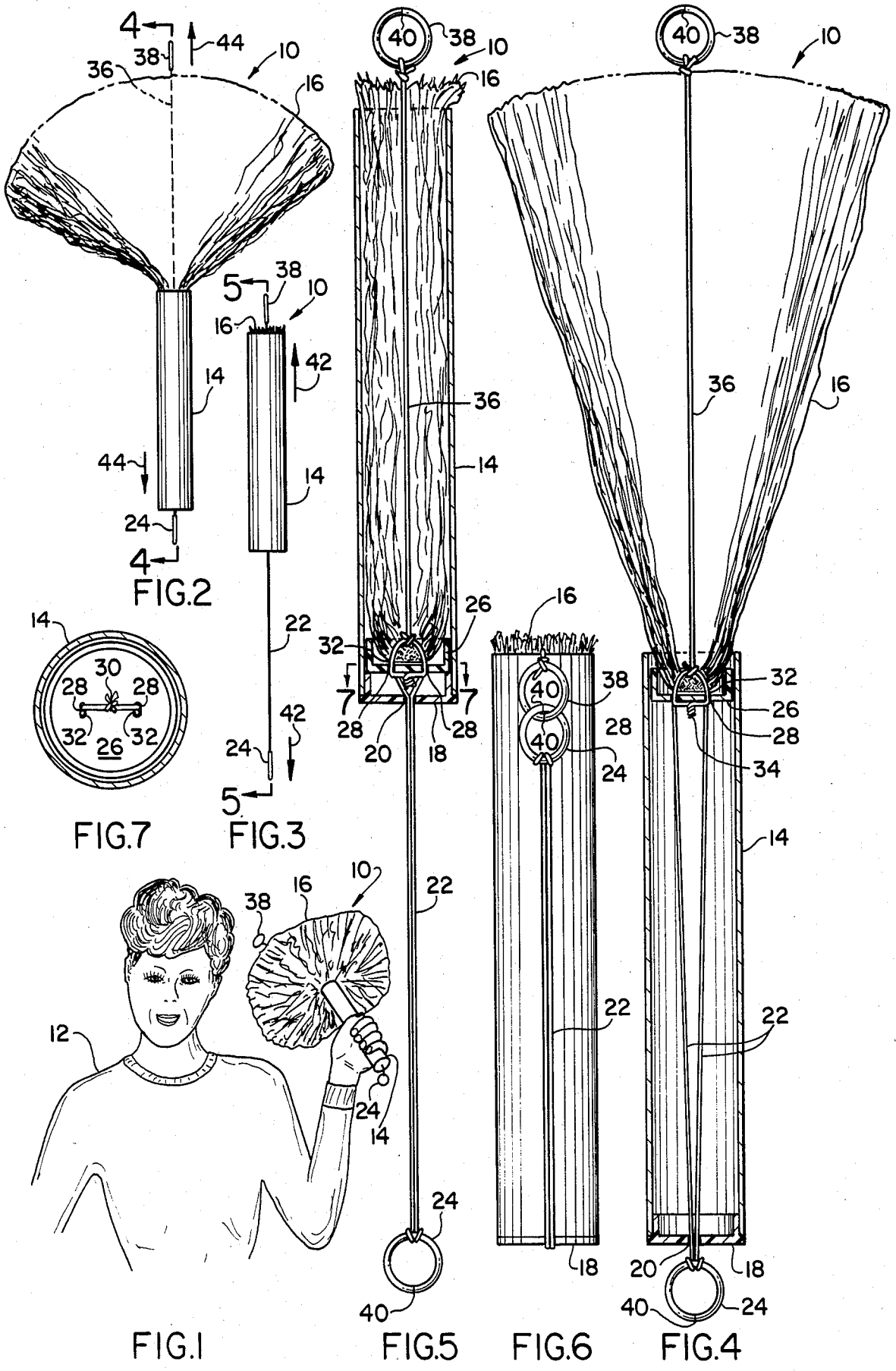
FIG. 1 illustrates a typical use of the within pompon in its display position.
FIG. 2 is an elevational view again showing the pompon in its display or deployed position.
FIG. 3 is an elevational view of the pompon device in a retracted or stored position.
FIG. 4 is a detailed sectional view of the device as taken along line 4—4 of FIG. 2.
FIG. 5 is another detailed sectional view of the device as taken along line 5—5 of FIG. 3.
FIG. 6 is an elevational view of the device with the pompon in its stored position.
FIG. 7 is a sectional view taken along line 7—7 in FIG. 5, drawn to a slightly larger scale.

Handle 14 is made of a cardboard or plastic tube which has within its lower end a fastened in-place plastic cap plug 18. Cap 18 has a centrally located through bore 20, through which passes a string loop 22. Tied to the lower end of string 22 is a ring 24 which acts as a stop member against cap 18, restraining further exiting movement of streamer cup 26. Streamer cup 26, as seen in plan view in FIG. 7, is slidably disposed within handle 14, and has a pair of opposed through bores 28 through which passes string loop 22. Loop 22 is completed at knot 30 (FIG. 7).

Streamers 16 are typically cut from paper or plastic strips ⅛ to ¼" wide and of a length approximately twice that of handle 14. A multitude of such streamers is attached at its midpoint by a tie wire loop 32 whose legs are made to pass through holes 28 in cup 26. Before the final twisting 34 of the tie wire 32, a single cord or string 36 is tied within the tie wire 32 loop along with streamers 16. String 36 is of a length approximately that of a half streamer 16. Tied to the distal end of string 36 is a second ring 38.

Should the user desire to set aside or to store the pompon, he or she can pull on string 22 by grasping ring 24 in one hand and by grasping handle 14 with the other hand. A pulling action 42 (FIG. 3) moves streamer cup 26 well into the handle 14 and streamers 16 follow accordingly to the position shown in FIGS. 3 and 5.

When a multitude of pompons are shipped or stored, it is desirable that the streamers 16 be retracted within the handle 14 to conserve space and to protect the streamers from dust, fading and tangling. It is also desirable that strings 22 be prevented from tangling with other strings 22. To this end, joints 40 in rings 24 and 38 can be interlocked as shown in FIG. 6. It is intended that rings 24 and 38 be made rigid enough to support pulling of respective string 22 and 36 and yet be made "springy" enough to deflect under force and interlock when required.

When it is desired to deploy the streamers 16, that is, to move the streamers 16 from the storage position shown in FIG. 5 to the display position shown in FIG. 4, the user may grasp handle 14 in one hand and pull on string 36 by grasping ring 38 with the other hand. A pulling action 44 (FIG. 2) moves streamer cup 26 towards the uncapped end of handle 14 with subsequent exiting movement of the streamers 16.

While the particular pompon herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. An improved pompon comprising a hollow tubular handle of a selected length bounding an internal storage compartment having an upper opening into said compartment and a bottom closure, a cup slidably disposed in said compartment having pompon streamers extending therefrom, a first string with a cooperating first pull ring connected to extend from said cup in the direction of said streamers so that a pulling of said first pull ring urges said cup towards said upper compartment opening and projects said streamers into a display condition through said upper compartment opening, and a second string with a cooperating second pull ring connected to extend from said cup in an opposite direction, said second string being of the same selected length as said tubular handle so that said second pull ring is adapted to abut against said handle bottom closure to thereby serve as a stop limiting the sliding movement of said cup to a position still within the compartment when said cup is adjacent the upper opening thereof, and whereby said second pull ring is adapted in response to a pulling thereof to urge said cup through sliding movement against said bottom closure and pull said streamers into a storage position within said handle.

2. An improved pompon as claimed in claim 1 wherein with said streamers in said storage position within said compartment said first string is of a length so as to position said first pull ring thereon adjacent said compartment upper opening and said second pull ring is adapted to extend along the exterior of said handle and interconnect with said first pull ring.

3. An improved pompon as claimed in claim 1 wherein said cup has a bottom wall with a spaced pair of openings therein, and said first and second strings are looped from opposite directions, through said openings so as to extend in opposite directions from said cup.

* * * * *